US009560909B2

(12) United States Patent
Krpan

(10) Patent No.: US 9,560,909 B2
(45) Date of Patent: Feb. 7, 2017

(54) GARMENT STRAP CLIP

(71) Applicant: John Krpan, San Diego, CA (US)

(72) Inventor: John Krpan, San Diego, CA (US)

( * ) Notice: Subject to any disclaimer, the term of this patent is extended or adjusted under 35 U.S.C. 154(b) by 0 days.

(21) Appl. No.: 14/556,653

(22) Filed: Dec. 1, 2014

(65) Prior Publication Data

US 2016/0150873 A1 Jun. 2, 2016

(51) Int. Cl.

| | |
|---|---|
| ***A45F 5/02*** | (2006.01) |
| ***A44B 11/00*** | (2006.01) |
| *A44B 9/18* | (2006.01) |
| *A41F 15/00* | (2006.01) |

(52) U.S. Cl.

CPC ..... *A45F 5/02* (2013.01); *A44B 11/006* (2013.01); *A41F 15/00* (2013.01); *A44B 9/18* (2013.01)

(58) Field of Classification Search

CPC ..... A45F 5/02; A44B 11/04; A44B 11/02; A44B 11/06; A44B 11/12; A44B 11/006; A44B 9/18; A41F 15/00

USPC ..... 24/265 AL, 265 EC, 265 BC, 318, 316, 24/323

See application file for complete search history.

(56) References Cited

U.S. PATENT DOCUMENTS 555,004 A * 2/1896 Harris ..... A44B 11/04 24/198
627,370 A * 6/1899 Weiss ..... A44B 11/00 24/198
2,551,019 A * 5/1951 La Pierre ..... A44B 99/00 24/3.12
2,664,610 A * 1/1954 Hannemann ..... B64D 17/38 24/265 H
D184,191 S * 12/1958 Noe ..... D11/216
2,940,792 A * 6/1960 Rubinstein ..... B64D 17/38 294/82.25
3,121,932 A * 2/1964 Grafstein ..... A44B 9/18 24/517
3,624,813 A * 11/1971 Gaylord ..... B64D 17/22 24/600.2
4,038,726 A * 8/1977 Takabayashi ..... A44B 11/06 24/169
4,227,730 A * 10/1980 Alexander ..... A61B 17/122 294/131
5,177,837 A * 1/1993 Rekuc ..... A44B 11/00 24/198
5,598,608 A * 2/1997 Naslund ..... B65D 33/1675 24/30.5 P
5,669,118 A * 9/1997 Frano ..... A44B 11/04 24/198
5,706,560 A * 1/1998 Anscher ..... A44B 11/02 24/30.5 P (Continued)

FOREIGN PATENT DOCUMENTS

EP 1488714 A1 12/2004

*Primary Examiner* — Robert J Sandy
*Assistant Examiner* — Rowland Do
(74) *Attorney, Agent, or Firm* — Garrett James O'Sullivan

(57) ABSTRACT

A garment strap clip has a closed upper loop and an open lower loop. The lower loop is formed by a hinged or unhinged arm extending from a first end of the upper loop that terminates in a first connector. The first connector engages with a second connector extending from a point near the second end of the upper loop to close the lower loop. The upper and lower loops are generally co-planar and are in immediate connection with one another. A tube can be attached to the upper loop to retrofit the clip. Alternatively, the upper loop is replaced by a tube for retrofitting the clip.

9 Claims, 12 Drawing Sheets

(56) References Cited

U.S. PATENT DOCUMENTS

| | | | | |
|---|---|---|---|---|
| D398,881 | S | 9/1998 | France-Davis | |
| 6,101,687 | A * | 8/2000 | Giampavolo | B60N 2/265 24/265 AL |
| 6,101,690 | A * | 8/2000 | Giampavolo | A47D 15/006 24/16 PB |
| 6,435,940 | B1 | 8/2002 | Fildan et al. | |
| 7,219,398 | B1 * | 5/2007 | Hunt | F16G 11/00 24/115 R |
| 7,234,995 | B2 | 6/2007 | Fildan et al. | |
| D571,254 | S | 6/2008 | Wanzenbock | |
| D586,257 | S * | 2/2009 | Goldman | D11/200 |
| 7,651,169 | B2 * | 1/2010 | Collins | A47D 15/006 297/468 |
| D621,296 | S | 8/2010 | Kennelty | |
| 8,407,866 | B2 | 4/2013 | Pontaoe | |
| 8,668,551 | B1 | 3/2014 | Folino | |
| D735,074 | S * | 7/2015 | Paik | D11/200 |
| 2002/0062541 | A1 | 5/2002 | Fildan et al. | |
| 2006/0162134 | A1 * | 7/2006 | Sun | A44B 11/2592 24/265 AL |
| 2008/0104802 | A1 * | 5/2008 | Vermillion | A45F 5/02 24/3.12 |

* cited by examiner

GARMENT STRAP CLIP

FIELD OF THE INVENTION

The present invention relates to clips for connecting support straps, or other types of straps, to men's and women's garments.

BACKGROUND OF THE INVENTION

Garments are commonly designed with straps for both functional (support) and aesthetic (decorative) purposes. Garments having straps include, among other things, bras, lingerie, swimsuits and various tops. Common examples of garment straps include, among other things, shoulder straps, garter straps, trouser suspenders and sock suspenders. Oftentimes, the straps are designed to be removed and/or interchanged to allow the user more versatility. As an example, a very popular bra design is the convertible bra. With a convertible bra, the bra strap can be detached and rearranged in different configurations depending on the outer garment.

Typically, straps are connected to a garment via a clip configured with a closed loop permanently affixed to one end of the strap. Attached to the loop is a fixed C-shaped retention member having a hooked end for engaging with a garment strap eye attached to the garment at the garment's strap connection point(s), the eye generally being constructed of fabric or plastic. Although commonly used throughout the clothing industry, this configuration can be quite problematic for several reasons. First of all, when detaching a strap from a garment, the hooked end of the clip commonly becomes snagged on the eye, adding difficulty and frustration to the reconfiguration process, especially in a hurried situation. As a further consequence of the user's frustration that builds in these situations, a clip, commonly constructed of thin plastic or metal, becomes subject to breakage and/or deformity. Contrary to the aforementioned issue, another problem that commonly arises with the current clip technology is the unexpected uncoupling of the strap from the garment. This issue arises when the hook fails to retain the cloth loop, causing the strap to separate from the article, potentially resulting in an embarrassing wardrobe malfunction for the user.

Based on the foregoing, there is a need in the art for a garment strap clip that provides consistent ease of uncoupling and reconfiguration of the strap. Additionally, there is a need in the art for a clip that securely fastens the strap to the garment, and prevents unexpected and/or unwanted uncoupling of the strap from the garment.

SUMMARY OF THE INVENTION

In an embodiment, a garment strap clip has a closed upper loop configured to hold a garment strap, the upper loop having first and second ends; an open lower loop configured to releasably retain a garment strap eye, the lower loop being formed by an arm extending from the first end and terminating in a first connector; and a second connector extending from a point near the second end. The upper and lower loops are generally co-planar and are in immediate connection with one another and the arm extends in a U-shape towards the second end where the first and second connectors releasingly engage with one another to close the lower loop and retain the eye.

In an embodiment, the upper and lower loops are elongated and are fixedly connected along a common edge.

In an embodiment, the lower loop is resilient.

In an embodiment, the first and second connectors together form a closure, and the closure is selected from the group consisting of a hook and loop closure, a U-shaped compression closure, a figure eight closure, a pass-through closure, a toggle closure, a lanyard clip closure, a lobster claw closure, a springring closure, an S-hook closure and a barrel clasp closure.

In an embodiment, the clip has a hinge in the arm at a point generally in vertical alignment with the second end, wherein the hinge allows the arm to move between an open and a closed position, wherein in the open position, the arm is configured to pass through and engage with the eye, wherein the eye slides on the arm to an interior portion of the lower loop, and wherein in the closed position the eye is retained within the lower loop when the lower loop is releasably closed through engagement of the first and second connectors. Furthermore, in an embodiment, the first and second connectors together form a closure, and the closure is selected from the group consisting of a hook and loop closure, a U-shaped compression closure, a figure eight closure, a pass-through closure, a toggle closure, a lanyard clip closure, a lobster claw closure, a springring closure, an S-hook closure and a barrel clasp closure.

In an embodiment, a hollow tube is attached to the upper loop, wherein the tube passes through, and extends above, the upper loop. Furthermore, in an embodiment, the tube is made of fabric or plastic, and is formed by a piece of fabric or plastic being passed through the upper loop and being affixed to itself, affixing the fabric or plastic tube to the upper loop. Furthermore, in an embodiment, the first and second connectors together form a closure, and the closure is selected from the group consisting of a hook and loop closure, a U-shaped compression closure, a figure eight closure, a pass-through closure, a toggle closure, a lanyard clip closure, a lobster claw closure, a springring closure, an S-hook closure and a barrel clasp closure. Furthermore, in an embodiment, there is a hinge in the arm at a point generally in vertical alignment with the second end, wherein the hinge allows the arm to move between an open and a closed position, wherein in the open position, the arm is configured to pass through and engage with the eye, wherein the eye slides on the arm to an interior portion of the lower loop, and wherein in the closed position the eye is retained within the lower loop when the lower loop is releasably closed through engagement of the first and second connectors.

In an embodiment, the garment strap clip has a hollow tube configured to receive a C-shaped retention member of a garment strap clip, the tube having first and second ends, wherein at least one end of the tube is open; an open loop configured to releasably retain a garment strap eye, the loop being formed by an arm extending from a point near the first end and terminating in a first connector; and a second connector extending from a point near the second end. The tube and loop are generally co-planar and are in immediate connection with one another, and wherein the arm extends in a U-shape towards the second end where the first and second connectors releasingly engage with one another to close the loop and retain the eye.

In an embodiment, the tube is a flattened tube having a shorter and longer diameter, wherein the longer diameter is generally co-planar with the loop.

In an embodiment, the tube and the loop are fixedly connected along a common edge.

In an embodiment, the loop is resilient.

In an embodiment, the first and second connectors together form a closure, and the closure is selected from the group consisting of a hook and loop closure, a U-shaped compression closure, a figure eight closure, a pass-through closure, a toggle closure, a lanyard clip closure, a lobster claw closure, a springring closure, an S-hook closure and a barrel clasp closure.

In an embodiment, the clip has a hinge in the arm at a point generally in vertical alignment with the second end of the tube, wherein the hinge allows the arm to move between an open and a closed position, wherein in the open position, the arm is configured to pass through and engage with the eye, wherein the eye slides on the arm to an interior portion of the loop, and wherein in the closed position the eye is retained within the loop when the loop is releasably closed through engagement of the first and second connectors. Furthermore, in an embodiment, the first and second connectors together form a closure, and the closure is selected from the group consisting of a hook and loop closure, a U-shaped compression closure, a figure eight closure, a pass-through closure, a toggle closure, a lanyard clip closure, a lobster claw closure, a springring closure, an S-hook closure and a barrel clasp closure.

In an embodiment, the tube is made of fabric or plastic, and is formed by a piece of fabric or plastic being passed through the loop, the fabric or plastic being directed upward as it passes through the loop and then being sewn, or affixed, to itself at a point not having yet passed through the loop, affixing the tube to the loop. Furthermore, in an embodiment, the first and second connectors together form a closure, and the closure is selected from the group consisting of a hook and loop closure, a U-shaped compression closure, a figure eight closure, a pass-through closure, a toggle closure, a lanyard clip closure, a lobster claw closure, a springring closure, an S-hook closure and a barrel clasp closure. Furthermore, in an embodiment, the clip has a hinge in the arm at a point generally in vertical alignment with the second end of the tube, wherein the hinge allows the arm to move between an open and a closed position, wherein in the open position, the arm is configured to pass through and engage with the eye, wherein the eye slides on the arm to an interior portion of the loop, and wherein in the closed position the eye is retained within the loop when the loop is releasably closed through engagement of the first and second connectors.

BRIEF DESCRIPTION OF THE FIGURES

For a more complete understanding of the present invention, the objects and advantages thereof, reference is now made to the ensuing descriptions taken in connection with the accompanying figures briefly described as follows.

DETAILED DESCRIPTION OF PREFERRED EMBODIMENTS

Figure 1A:
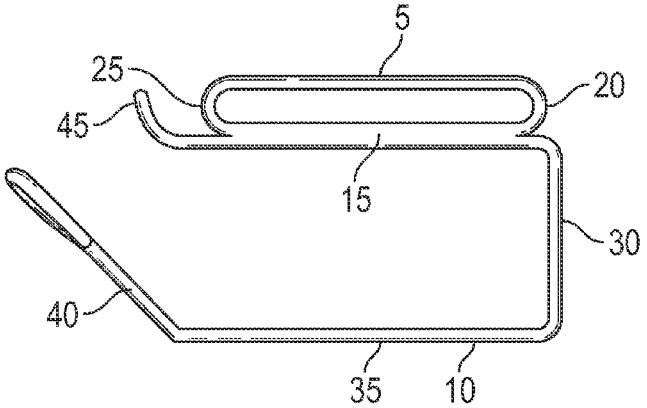
FIG. 1A is a front elevation view of the of the garment strap clip with the lower loop in the open position, according to an embodiment of the present invention.
Figure 1B:
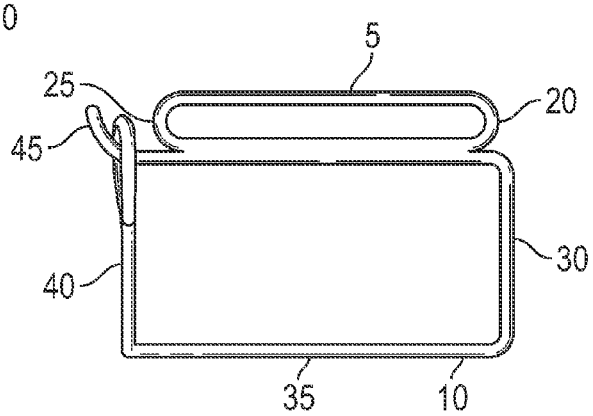
FIG. 1B is a front elevation view of the garment strap clip with the lower loop in the closed position, according to an embodiment of the present invention.
Figure 1C:
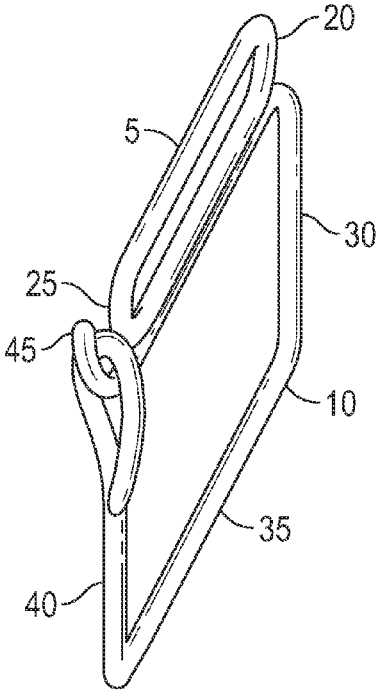
FIG. 1C is a perspective view of the garment strap clip with the lower loop in the closed position, according to an embodiment of the present invention.

Preferred embodiments of the present invention and its advantages may be understood by referring to FIGS. 1A-12B wherein like reference numerals refer to like elements.

With reference to FIGS. 1A-1D, an embodiment of the garment strap clip has an upper loop 5 and a lower loop 10. The loops 5, 10 are generally co-planar and are in immediate connection with one another, and in one embodiment the upper and lower loops 5, 10 share a common edge 15 and are fixedly connected. The upper loop 5 is a closed loop, having a first end 20 and a second end 25, and forms an elongated oval in one embodiment. The lower loop 10 forms a U-shape below the upper loop 5, having a length generally corresponding to the length of the upper loop 5. The lower loop 10 has an arm 30 that extends downward from a point at or near the upper loop's first end 20, continuing through a transverse portion 35 across the bottom of the lower loop 10, and terminates with a first connector 40. From the upper loop's second end 25, a mating second connector 45 is configured to releasingly engage with the first connector 40.

The upper loop 5 is configured to engage with a garment strap 50 that is sewn to itself once having passed through the upper loop 5, retaining the upper loop 5. The lower loop 10 has an open position, shown in FIG. 1A, and a closed position, shown in FIGS. 1B-1D, wherein in the open position, the lower loop 10 is configured to engage or disengage with a garment strap eye 55, the eye 55 being configured as a loop and being fixedly attached to the garment at the garment's strap connection points (not shown), and wherein in the closed position, the lower loop 10 is configured to releasably retain the eye 55. In the closed position, the first and second connectors 40, 45 releasingly engage with one another to releasably close the lower loop 10. In an embodiment, the lower loop 10 is constructed of a pliable and resilient material to prevent breakage and deformity, while allowing flexibility for the user to transition between the open and closed positions.

In an embodiment, a fabric or plastic tube is attached to the upper loop 5, wherein the tube is formed by a piece of fabric or plastic being passed through the upper loop 5, the fabric or plastic being directed upward as it passes through the upper loop 5 and then being sewn, or affixed, to itself at a point not having yet passed through the upper loop 5, closing the tube and affixing it to the upper loop 5. In an embodiment, the tube generally corresponds in length to the upper loop 5. This configuration, wherein the tube is connected to the upper loop 5, allows users to retrofit the presently described clip to clothing having straps with prior art clips. For example, the prior art clip engages with the presently described clip by sliding the prior art clip's C-shaped retention member through the tube of the presently described clip. Once the retention member has passed through the tube, the hook or lateral protrusion catches on the edge of the tube, releasably connecting the prior art clip to the presently described clip, and prevents the inadvertent and/or unwanted removal of the retention member from the tube.

Figure 1D:
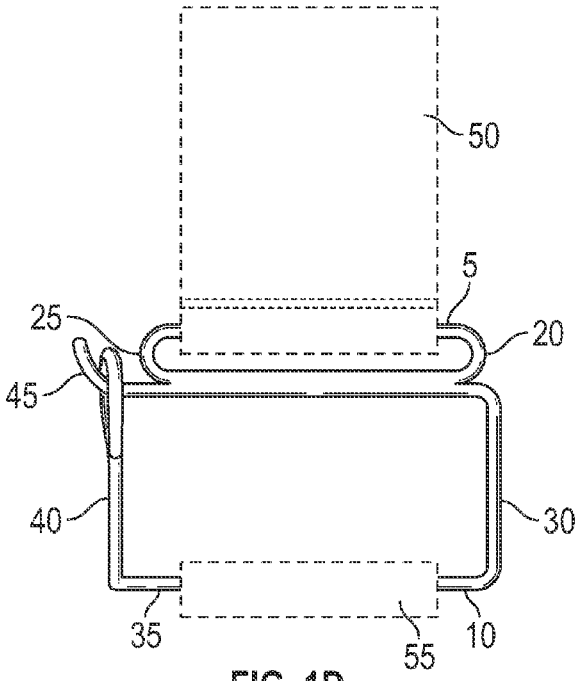
FIG. 1D is a front elevation view of the garment strap clip in the closed position, according to an embodiment of the present invention.
Figure 2A:
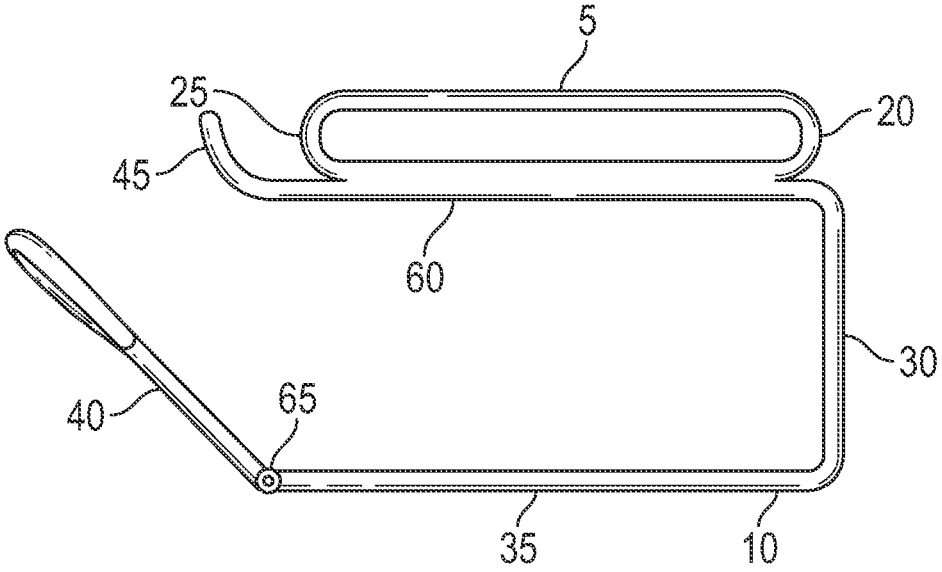
FIG. 2A is a front elevation view of the garment strap clip with the lower loop in the open position, according to an embodiment of the present invention.
Figure 2B:
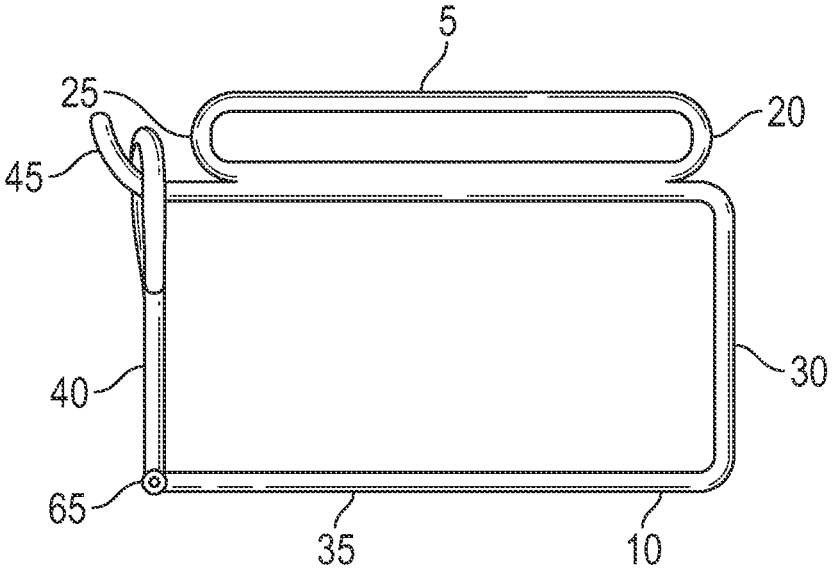
FIG. 2B is a front elevation view of the garment strap clip with the lower loop in the closed position, according to an embodiment of the present invention.

With reference to FIGS. 2A-2B, an embodiment of the garment strap clip is shown, wherein the arm 30 extends downward from the upper loop's first end 20, forming the lower loop 10 below the upper loop's lower edge 60. The lower loop 10 generally corresponds in length to the upper loop 5. At a point generally in vertical alignment with the upper loop's second end 25, the arm 30 has a hinge 65 allowing the first connector 40 to move between the open and closed positions. In the open position, the end of the arm 30 extends outwardly from the transverse portion 35 beyond the second end 25, creating an opening for the lower loop 10 to engage or disengage with the eye 55 shown in FIG. 1D at the garment's strap connection point (not shown). In the closed position, the first connector 40 extends upward toward the second end 25 where the first and second connectors 40, 45 releasingly engage with one another to releasably close the lower loop 10. In the closed position, the eye 55 is retained within the lower loop 10.

Figure 3A:
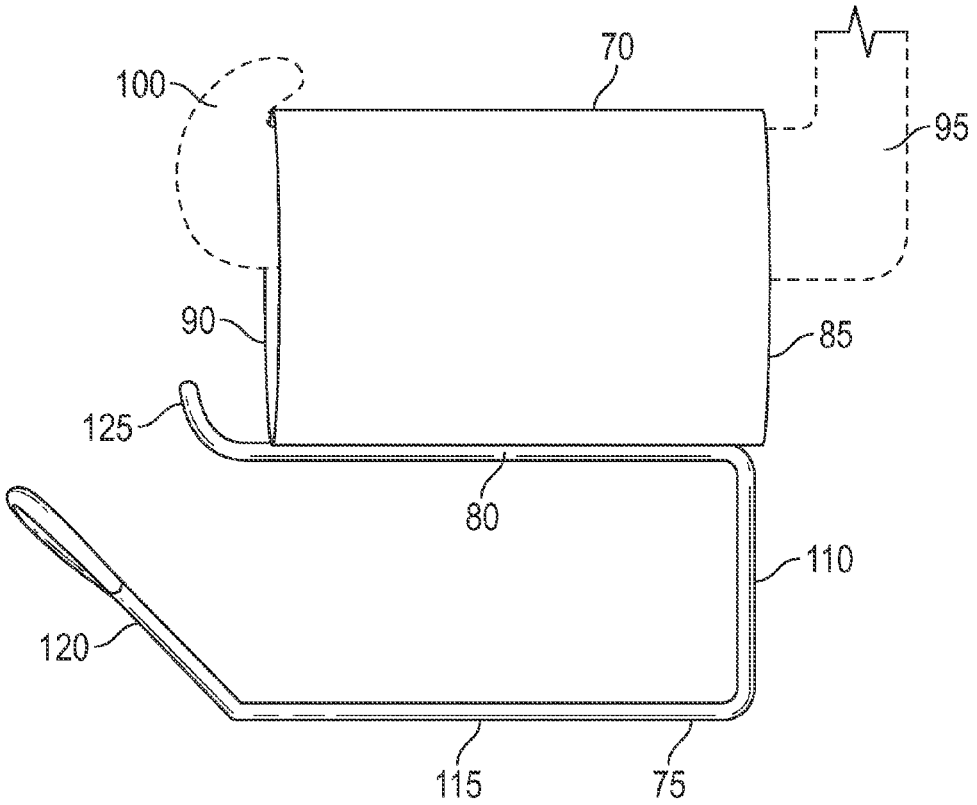
FIG. 3A is a front elevation view of the garment strap clip in which the upper loop is replaced by a tube and the loop is in the open position, according to an embodiment of the present invention.
Figure 3B:
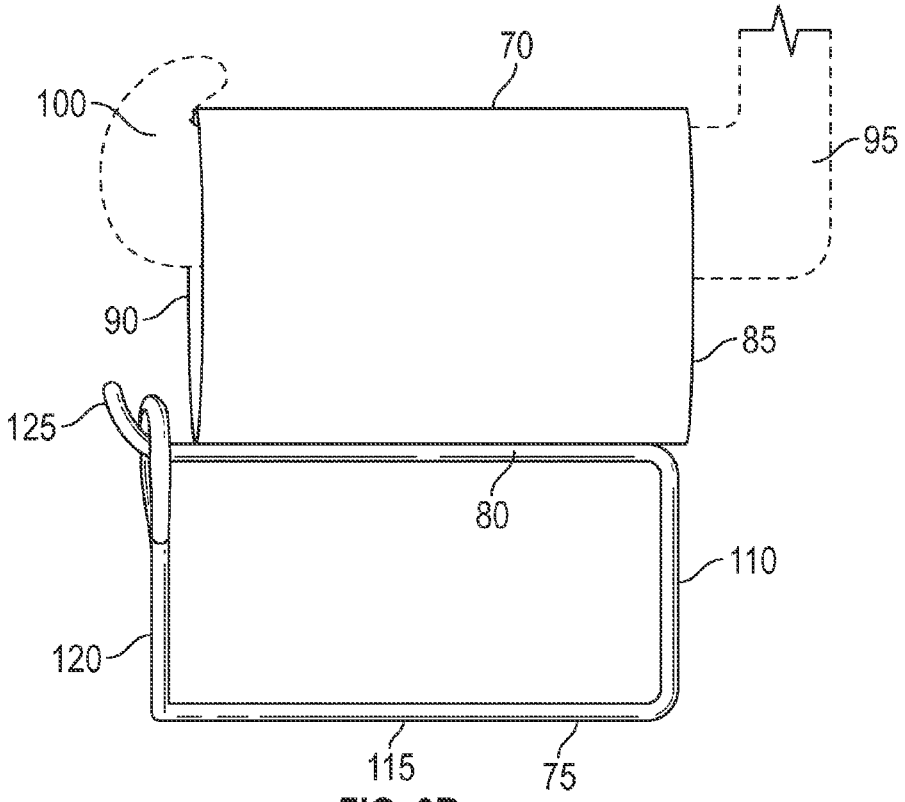
FIG. 3B is a front elevation view of the garment strap clip in which the upper loop is replaced by a tube and the loop is in the closed position, according to an embodiment of the present invention.

With reference to FIGS. 3A-3B, an embodiment of the garment strap clip is configured with a generally cylindrical hollow tube 70 and a loop 75, wherein the tube 70 and loop 75 are generally co-planar and are in immediate connection with one another, and in one embodiment share a common edge 80. The tube has a first end 85 and a second end 90, at least one of which is open, wherein the tube is configured to receive the C-shaped retention member 95 of prior art clips having a hook 100 or other lateral protrusion at the end of the retention member 95. This configuration allows users to retrofit the presently described clip to clothing having straps with prior art clips. For example, the prior art clip engages with the presently described clip by sliding the retention member 95 through the tube 70. Once the retention member 95 has passed through the tube 70, the hook 100 or lateral protrusion catches on the edge of the tube 70, releasably connecting the prior art clip to the presently described clip, and prevents the inadvertent and/or unwanted removal of the retention member 95 from the tube 70.

In an embodiment, the tube is a fabric or plastic tube attached to the loop 75, wherein the tube is formed by a piece of fabric or plastic being passed through the loop 75, the fabric or plastic being directed upward as it passes through the loop 75 and then being sewn, or affixed, to itself at a point not having yet passed through the loop 75, closing the tube and affixing it to the loop 75.

In an embodiment, the loop 75 is constructed of a pliable and resilient material to prevent breakage and deformity, while allowing flexibility for the user to transition between the open and closed positions.

The loop 75 has an open position, shown in FIG. 3A and a closed position, shown in FIG. 3B. In the open position, the loop 75 is configured to engage or disengage with the eye 55 shown in FIG. 1D at the garment's strap connection point (not shown). In the closed position, the loop 75 is configured to releasably retain the eye 55 shown in FIG. 1D. The loop 75 forms a U-shape below the tube 70, having a length generally corresponding to the length of the tube 70. The loop 75 has an arm 110 extending downwardly from a point at or near the tube's first end 85, a transverse portion 115 of the arm 110 continues across the bottom, and the arm 110 terminates in a first connector 120. From the tube's second end 90, a mating second connector 125 is configured to releasingly engage with the first connector 120. In the closed position, the first and second connectors 120, 125 releasingly engage with one another to releasably close the loop 75.

In an embodiment, the tube 70 is a flattened tube, having two flat sides and two rounded sides, wherein the flat sides are generally co-planar with the loop 75. In an embodiment, the flattened tube has a shorter and longer diameter, wherein the longer diameter is generally co-planar with the loop 75. A flattened tube, as opposed to a more traditional rounded tube, provides utility by allowing the user to better conceal the clip underneath clothing due to less likelihood of a flat tube catching on clothing or other items and/or creating a visible protrusion as it contacts outer clothing.

In an embodiment, at a point generally in vertical alignment with the tube's second end 90, the arm 110 has a hinge as seen in FIGS. 2A-2B allowing the first connector 120 to move between the open and closed positions. In the open position, the end of the arm extends outwardly from the transverse portion 115 beyond the tube's second end 90, creating an opening for the loop 75 to accept the eye 55 shown in FIG. 1D. In the closed position, the first connector 120 extends upward toward the tube's second end 90 where the first and second connectors 120, 125 releasingly engage with one another to releasably close the loop 75. In the closed position, the eye as seen in FIG. 1D is retained within the loop 75.

With further reference to FIGS. 1A-3B and all embodiments described therefor, an embodiment of the garment strap clip uses a hook and loop closure, wherein the first connector 40, 120 is a loop, and the second connector 45, 125 is a hook extending outward and upward from a point at or near the second end 25, 90 in a generally co-planar fashion with the upper loop 5 or tube 70. The first connector 40, 120 releasingly engages with the second connector 45, 125 to releasably close the lower loop 10 or loop 75. In an embodiment, the first connector 40, 120 is constructed from a pliable and resilient material, allowing it to be stretched upward to engage with, and be retained by, the second connector 45, 125, releasably closing the lower loop 10 or loop 75. To re-open the lower loop 10 or loop 75, the first connector 40, 120 must be manipulated or stretched upward to allow it to be released from the second connector 45, 125.

Figure 4A:
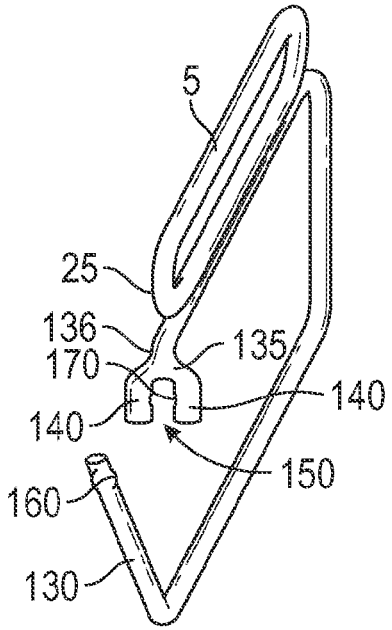
FIG. 4A is a perspective view of the garment strap clip in the open position having a U-shaped first connector, according to an embodiment of the present invention.
Figure 4B:
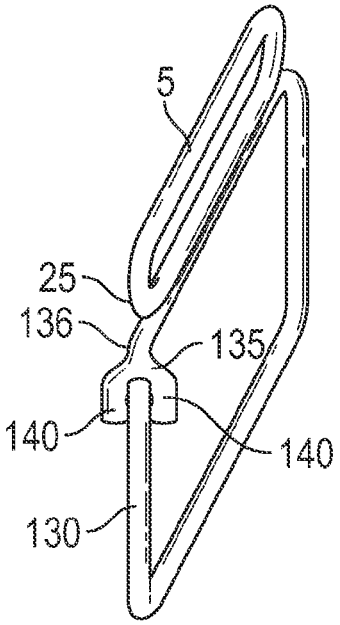
FIG. 4B is a perspective view of the garment strap clip in the closed position having a U-shaped first connector, according to an embodiment of the present invention.

With reference to FIGS. 4A and 4B, for each of the embodiments exemplified in FIGS. 1A-3B and further described and embodied herein, an embodiment of the garment strap clip has a U-shaped compression closure, having a rod-shaped first connector 130 and a mating U-shaped second connector 135, wherein the second connector 135 is attached to a stalk 136 extending outwardly from a point at or near the second end 25, 90 of the upper loop 5 or tube 70. The width of the first connector 130 generally corresponds with the width of the opening 150 of the second connector 135. The sides of the first connector 130 that engage with the second connector 135 have protrusions 160 extending therefrom. The second connector's interior walls have concave dimples 170 that correspond with, and accept, the first connector's protrusions 160 when the connectors 130, 135 are engaged with one another. The second connector's arms 140 have a restoring force when outward force is applied to them. When an external force is applied to the first connector 130 against the second connector 135, causing the first connector 130 to be inserted into the second connector 135, the protrusions 160 engage with the arms 140, pushing the arms 140 outward. When the connectors 130, 135 are aligned, the dimples 170 receive the protrusions 160, and the restoring force of the arms 140 causes the first connector 130 to snap into place. When fully engaged, the connectors 130, 135 remain in position due to the restoring force exerted by the second connector's arms 140 on the first connector 130, releasably closing the loop. The loop is re-opened by applying a force to the first connector 130 equal and opposite to the force exerted on the first connector 130 to close to the loop, overcoming the restoring force of the arms 140.

Figure 5A:
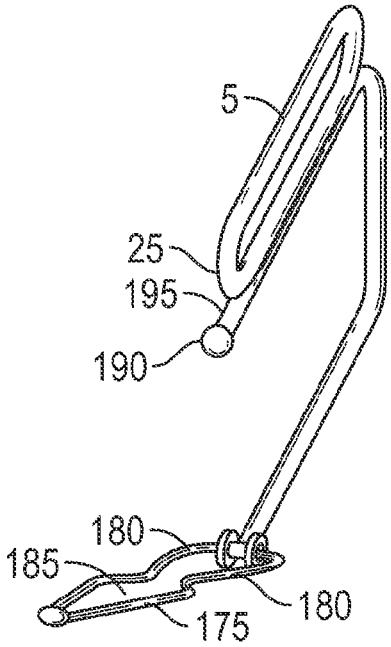
FIG. 5A is a perspective view of the garment strap clip in the open position having a "figure eight" clasp, according to an embodiment of the present invention.
Figure 5B:
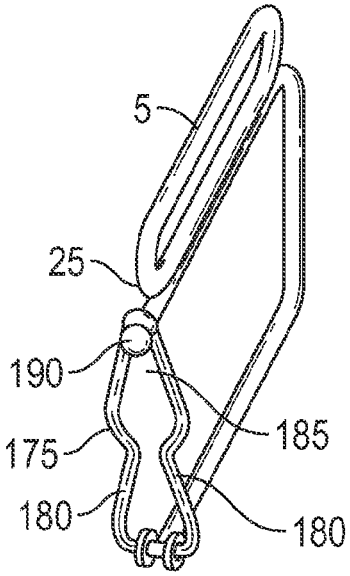
FIG. 5B is a perspective view of the garment strap clip in the closed position having a "figure eight" clasp, according to an embodiment of the present invention.

With reference to FIGS. 5A and 5B, for each of the embodiments exemplified in FIGS. 1A-3B and further described and embodied herein, an embodiment of the garment strap clip has a "figure eight" closure, wherein the first connector 175 is a "figure eight" shaped latch, having arms 180 that define an aperture 185 for receiving the second connector 190, wherein the latch arms 180 have a restoring force. The second connector 190 is generally ball-shaped and is attached to a stalk 195 extending outwardly from a point at or near the second end 25, 90 of the upper loop 5 or tube 70, the second connector 190 having a diameter greater than the diameter of the stalk 195. When the aperture 185 aligns with, and begins to receive, the second connector 190, a user pushes the first connector 175 toward the second connector 190, causing the latch arms 180 to open in opposition to their restoring force, allowing the second connector 190 to pass through the aperture 185. Once the second connector 190 passes through the aperture 185, the aperture 185 closes due to its restoring force, causing the first connector 175 to releasingly engage with the second connector 190 as the first connector 175 snaps into place between the second connector 190 and the second end 25, 90, releasably closing the loop. The loop is re-opened by applying a force to the first connector 175 equal and opposite to the force exerted on the first connector 175 to close to the loop, overcoming the restoring force of the latch arms 180.

Figure 6A:
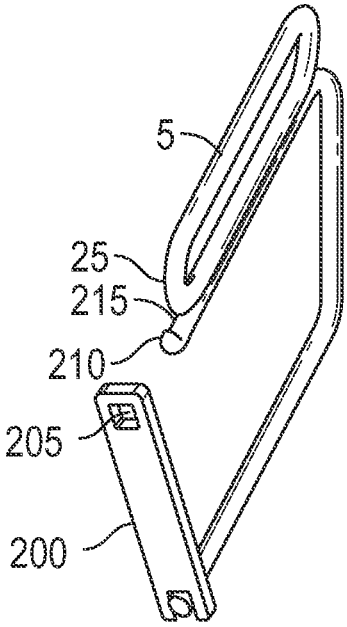
FIG. 6A is a perspective view of the garment strap clip in the open position having an aperture in the lower loop's arm configured to receive a ball shaped connector, according to an embodiment of the present invention.
Figure 6B:
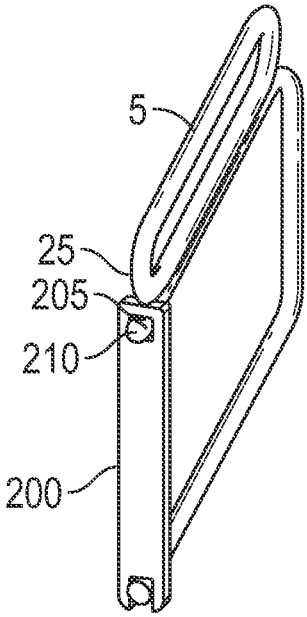
FIG. 6B is a perspective view of the garment strap clip in the closed position having an aperture in the lower loop's arm configured to receive a ball shaped connector, according to an embodiment of the present invention.

With reference to FIGS. 6A and 6B, for each of the embodiments exemplified in FIGS. 1A-3B and further described and embodied herein, an embodiment of the garment strap clip has a pass-through closure, wherein the first connector 200 has an aperture 205 for receiving a generally ball-shaped second connector 210. In an embodiment, the second connector is generally hook-shaped, and is oriented in a generally upward direction. The second connector 210 is attached to a stalk 215 extending outwardly from a point at or near the second end 25, 90 of the upper loop 5 or tube 70, the second connector 210 having a diameter greater than the diameter of the stalk 215, and the stalk 215 having a restoring force when manipulated downward. The aperture 205 corresponds, and generally aligns, with the second connector 210, with the top of the aperture 205 being slightly lower than the top of the second connector 210. The connectors 200, 210 engage when the second connector 210 is manipulated slightly downward in opposition to its restoring force and the first connector 200 is pushed in the direction of the second connector 210, allowing the second connector 210 to pass through the aperture 205. Once the second connector 210 passes through the aperture 205, the stalk's restoring force causes the second connector 210 to spring upward and snap into place with the top of the second connector 210 extending just above the top of the aperture 205, releasably closing the loop. Releasing the connectors 200, 210, and hence opening the loop is essentially the reverse of engaging the connectors 200, 210.

Figure 7A:
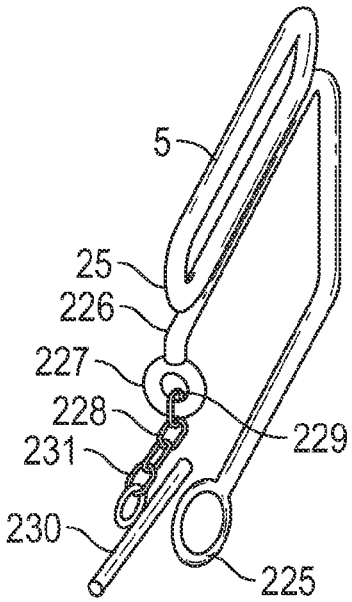
FIG. 7A is a perspective view of the garment strap clip in the open position having a toggle closure, according to an embodiment of the present invention.
Figure 7B:
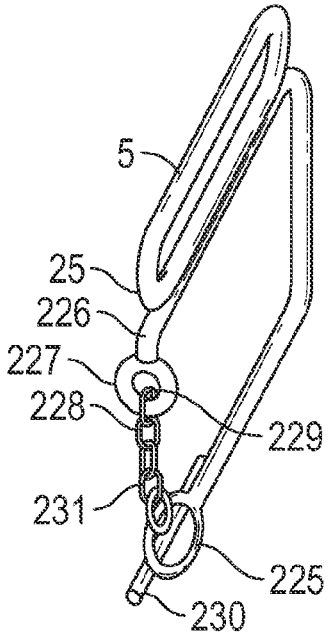
FIG. 7B is a perspective view of the garment strap clip in the closed position having a toggle closure, according to an embodiment of the present invention.

With reference to FIGS. 7A and 7B, for each of the embodiments exemplified in FIGS. 1A-3B and further described and embodied herein, an embodiment of the garment strap clip has a toggle closure, wherein the first connector 225 is an O-ring and the second connector 230 is a bar-shaped connector. In an embodiment, a stalk 226 extending outwardly from a point at or near the second end 25, 90 of the upper loop 5 or tube 70 has a circular member 227 fixedly attached to its end, wherein a chain 228, having a top end 229 and a bottom end 231, connects the circular member 227 to the second connector 230, the top end 229 being attached to the circular member 227 and the bottom end 231 being attached to the second connector 230. The length of the second connector 230 is greater than the diameter of the first connector 225. The second connector 230 passes through the first connector 225 when the first and second connectors 225, 230 are generally axially aligned.

Once the second connector 230 passes through and is no longer generally axially aligned with the first connector 225, the length of the second connector 230 prevents it from passing back through the first connector 225, releasably closing the loop. To re-open the loop, the connectors 225, 230 must be generally axially re-aligned, allowing the second connector 230 to pass back through the first connector 225.

Figure 8A:
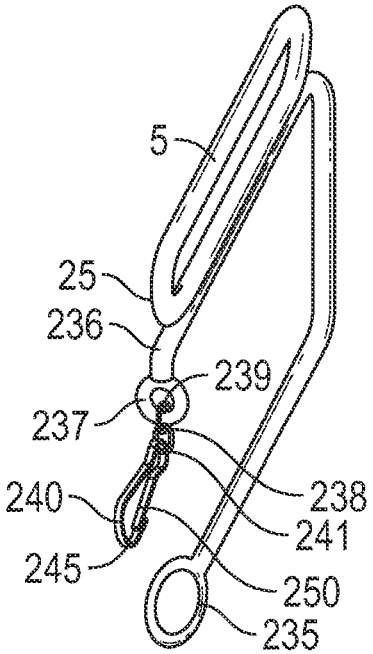
FIG. 8A is a perspective view of the garment strap clip in the open position having a lanyard clip and mating O-ring, according to an embodiment of the present invention.
Figure 8B:
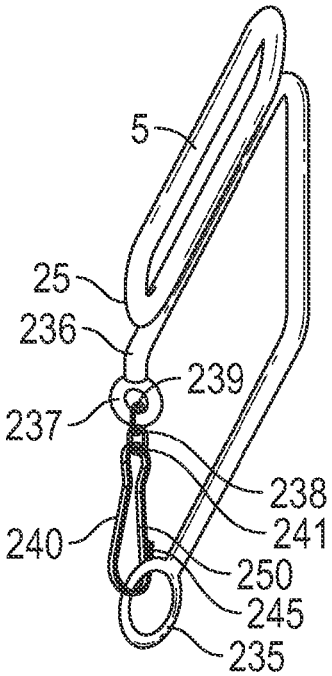
FIG. 8B is a perspective view of the garment strap clip in the closed position having a lanyard clip and mating O-ring, according to an embodiment of the present invention.

With reference to FIGS. 8A and 8B, for each of the embodiments exemplified in FIGS. 1A-3B and further described and embodied herein, an embodiment of the garment strap clip has a lanyard clip closure, wherein the first connector 235 is an O-ring and the second connector 240 is a lanyard clip. In an embodiment, a stalk 236 extending outwardly from a point at or near the second end 25, 90 of the upper loop 5 or tube 70 has a circular member 237 fixedly attached to its end, wherein a chain 238, having a top end 239 and a bottom end 241, connects the circular member 237 to the second connector 240, the top end 239 being attached to the circular member 237 and the bottom end 241 being attached to the second connector 240. The second connector 240, having a hook 245 and a latch arm 250, is biased to a closed position due to the restoring force of its latch arm 250 being biased against the hook 245. The second connector 240 engages with the first connector 235 when force is applied against the second connector's latch arm 250, pushing the latch arm 250 inward in opposition to its restoring force, allowing the hook 245 to pass through, and engage with, the first connector 235. Once the hook 245 passes through the first connector 235, the second connector 240 releasingly engages with the first connector 235 as the restoring force of the latch arm 250 causes it to close and retain the first connector 235, releasably closing the loop. To re-open the loop, the restoring force of the latch arm 250 must be overcome to allow the first connector 235 to be released from the second connector 240.

Figure 9A:
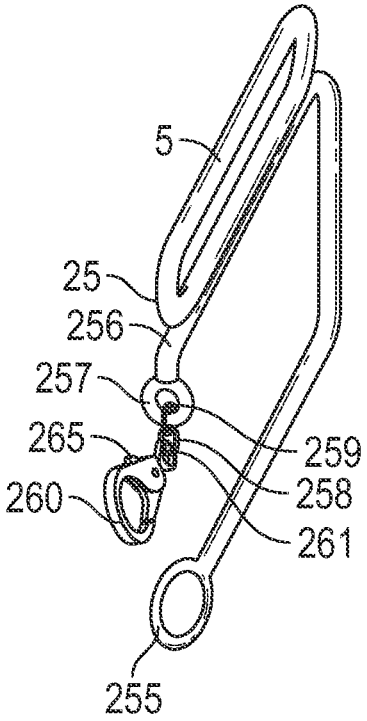
FIG. 9A is a perspective view of the garment strap clip in the open position having a lobster claw and mating O-ring, according to an embodiment of the present invention.
Figure 9B:
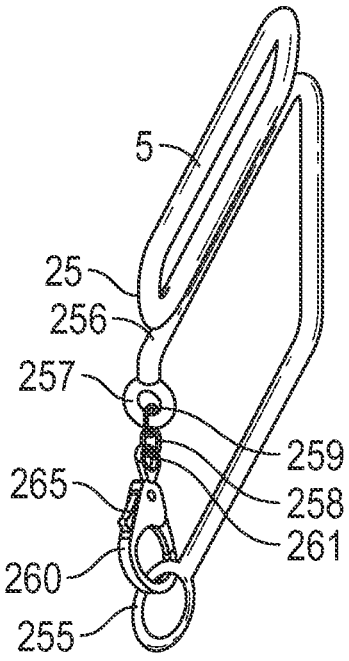
FIG. 9B is a perspective view of the garment strap clip in the closed position having a lobster claw and mating O-ring, according to an embodiment of the present invention.

With reference to FIGS. 9A and 9B, for each of the embodiments exemplified in FIGS. 1A-3B and further described and embodied herein, an embodiment of the garment strap clip has a lobster claw closure, wherein the first connector 255 is an O-ring and the second connector 260 is a lobster claw clasp. In an embodiment, a stalk 256 extending outwardly from a point at or near the second end 25, 90 of the upper loop 5 or tube 70 has a circular member 257 fixedly attached to its end, wherein a chain 258, having a top end 259 and a bottom end 261, connects the circular member 257 to the second connector 260, the top end 259 being attached to the circular member 257 and the bottom end 261 being attached to the second connector 260. The second connector 260, having an open and a closed position, is biased to the closed position, and has a spring-operated lever 265 configured to open the second connector 260. When a force opposite to, and greater than, the restoring force of the spring (not shown) attached to the lever 265 is exerted on the spring through operation of the lever 265, the second connector 260 opens, allowing the first connector 255 to be received by a hook 265 of the second connector 260. Once the hook 265 passes through the first connector and the lever 265 is released, the second connector 260 releasingly engages with the first connector 255 as the restoring force of the spring (not shown) causes the second connector 260 to close and retain the first connector 255, releasably closing the loop. The loop is opened by re-opening the second connector 260 and allowing the first connector 255 to be released from the second connector 260.

Figure 10A:
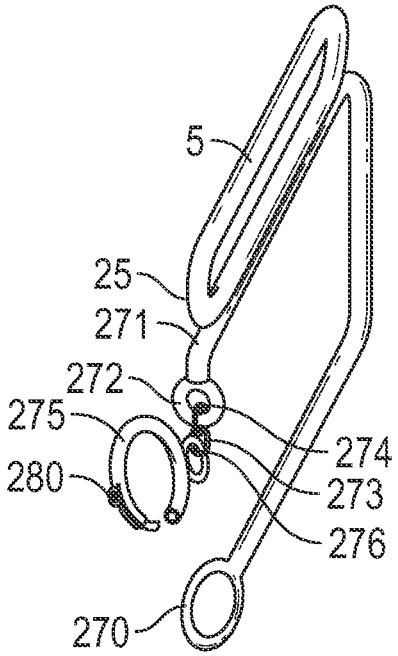
FIG. 10A is a perspective view of the garment strap clip in the open position having a springring clasp and mating O-ring, according to an embodiment of the present invention.
Figure 10B:
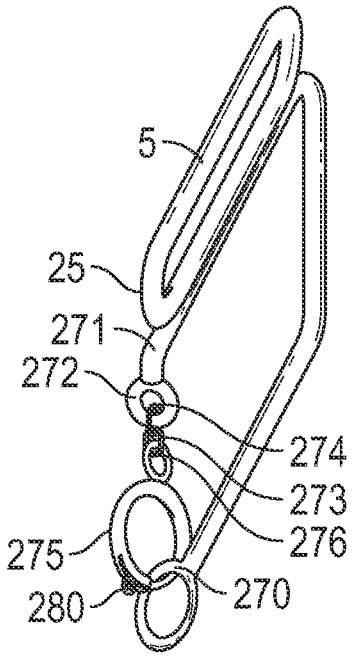
FIG. 10B is a perspective view of the garment strap clip in the closed position having a springring clasp and mating O-ring, according to an embodiment of the present invention.

With reference to FIGS. 10A and 10B, for each of the embodiments exemplified in FIGS. 1A-3B and further described and embodied herein, an embodiment of the garment strap clip has a springring closure, wherein the first connector 270 is a O-ring and the second connector 275 is an springring clasp. In an embodiment, a stalk 271 extending outwardly from a point at or near the second end 25, 90 of the upper loop 5 or tube 70 has a circular member 272 fixedly attached to its end, wherein a chain 273, having a top end 274 and a bottom end 276, connects the circular member 272 to the second connector 275, the top end 274 being attached to the circular member 272 and the bottom end 276 being attached to the second connector 275. The second connector 275 is biased to a closed position and has a spring-operated lever 280 configured to open it when a force opposite to, and greater than, the restoring force of the spring (not shown) is exerted on the spring via the lever 280. When the second connector 275 opens, it allows the first connector 270 to be received by the second connector 275. Once the connectors 270, 275 have fully engaged, the lever 280 is released, releasingly engaging the connectors 270, 275 as the restoring force of the spring causes the second connector 275 to close and retain the first connector 270, releasably closing the loop. The loop is opened by re-opening the second connector 275 and allowing the first connector 270 to be released from the second connector 275.

Figure 11A:
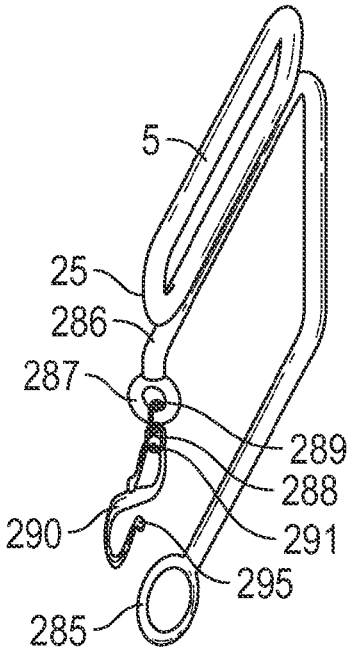
FIG. 11A is a perspective view of the garment strap clip in the open position having an S-hook and mating O-ring, according to an embodiment of the present invention.
Figure 11B:
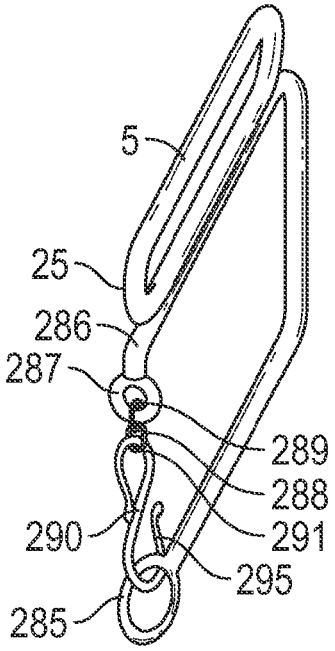
FIG. 11B is a perspective view of the garment strap clip in the closed position having an S-hook and mating O-ring, according to an embodiment of the present invention.

With reference to FIGS. 11A and 11B, for each of the embodiments exemplified in FIGS. 1A-3B and further described and embodied herein, an embodiment of the garment strap clip has an S-hook closure, wherein the first connector 285 is an O-ring and the second connector 290 is an S-hook. In an embodiment, a stalk 286 extending outwardly from a point at or near the second end 25, 90 of the upper loop 5 or tube 70 has a circular member 287 fixedly attached to its end, wherein a chain 288, having a top end 289 and a bottom end 291, connects the circular member 287 to the second connector 290, the top end 289 being attached to the circular member 287 and the bottom end 291 being attached to the second connector 290. In an embodiment, the second connector 290 is constructed of a pliable and resilient material, allowing the hook 295 of the "S" to spring back to its native shape after being stretched or flexed. The hook 295 is manipulated to a configuration allowing it to pass through and engage with the first connector 285. Once the hook 295 is inserted through the first connector 285, the hook 295 springs back to its native configuration, causing the second connector 290 to releasingly engage with the mating first connector 285 to releasably close the loop. The loop is re-opened by manipulating the hook 295 to allow the first connector 285 to be released.

Figure 12A:
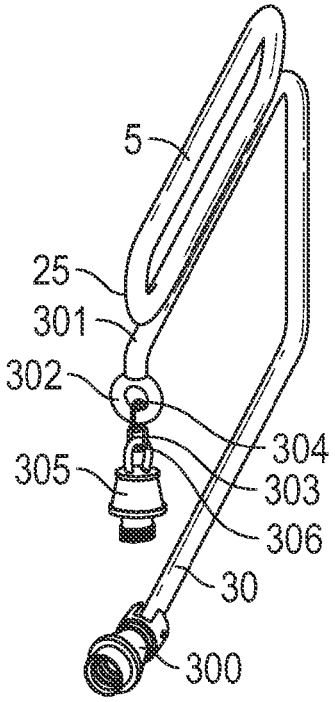
FIG. 12A is a perspective view of the garment strap clip in the open position having a barrel clasp, according to an embodiment of the present invention.
Figure 12B:
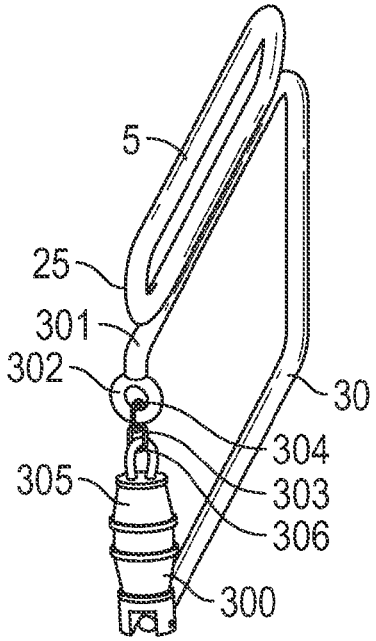
FIG. 12B is a perspective view of the garment strap clip in the closed position having a barrel clasp, according to an embodiment of the present invention.

With reference to FIGS. 12A and 12B, for each of the embodiments exemplified in FIGS. 1A-3B and further described and embodied herein, an embodiment of the garment strap clip has a barrel clasp closure, wherein the first connector 300 and second connector 305 are mating halves of the barrel clasp. In an embodiment, the first connector 300 is hingedly connected to the arm 30, 110, and a stalk 301 extending outwardly from a point at or near the second end 25, 90 of the upper loop 5 or tube 70 has a circular member 302 fixedly attached to its end, wherein a chain 303, having a top end 304 and a bottom end 306, connects the circular member 302 to the second connector 305, the top end 304 being attached to the circular member 302 and the bottom end 306 being attached to the second connector 305. The connectors 300, 305 releasingly engage with one another when the first connector 300 extends upward to releasably engage with the second connector 305 by way of mated threading, an expansion spring fitting or some other form of pressure fitting to releasably close the loop. The loop is re-opened by reversing the closure process.

In an embodiment, the clip is constructed from one or more rigid materials including, but not limited to, coated or uncoated metal, plastic or a polymer. The rigid material provides strength to prevent breakage or deformity, while also providing structure, allowing, for example, a hinged arm to easily engage with and accept the eyes.

In an embodiment, the clip is constructed from one or more pliable and/or resilient materials including, but not limited to, rubber, plastic, metal wire or a polymer. A pliable and resilient material can be temporarily deformed and then return to its original configuration due to a restoring force. Further, the flexibility of a pliable and resilient material resists breakage and deformity and allows a greater breadth of use. For example, the use of rigid materials requires the use of a hinged arm to open the lower loop; whereas, the use of pliable materials allows the clip to be configured with either a hinged or unhinged arm to easily engage with and accept the eyes.

In an embodiment, the clip is constructed from a combination of one or more pliable and/or resilient materials and one or more rigid materials including, but not limited to, coated or uncoated metal, rubber, plastic, metal wire or a polymer. The combination of rigid and pliable materials together in a single application provides the benefits of both rigid and pliable materials for greater breadth of use. For example, in an embodiment, a metal or rigid plastic could be used to form the frame of the clip, providing added strength, while a rubber loop at the end of the arm could be used for stretching and securely engaging with the metal or hard plastic hook.

In an alternative embodiment, a lobster claw clasp or lanyard clip is connected to at least one end of a garment strap, by any number of means known to one skilled in the art, allowing the user to quickly and easily add, remove, interchange and/or reconfigure the garment strap. See the description of FIGS. 8A-9B and the respective figures for an overview and reference of the operation of a lanyard clip and a lobster claw clasp. The lobster claw clasp and the lanyard clip, each having an open and a closed position, are biased to the closed position by a restoring force. When manually manipulated by the user, the restoring force of the clasp's spring or the clip's latch arm can be overcome by a force opposite to, and greater than, the respective restoring force, opening the clasp or clip. In the open position, a hook on either the clasp or the clip passes through, and receives, an eye at the garment strap connection point on a garment. Once the eye has been fully received, the user allows the clasp or clip to close by releasing the opposing force, retaining the eye. The clasp or clip is removed from the eye by reversing the attachment process.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A garment strap clip comprising:

a. a closed upper loop, the upper loop having a first end and a second end;

b. an open lower loop, the lower loop being formed by an arm extending from a point at or near the first end and terminating in a loop connector; and c. a hook connector extending from a point at or near the second end, wherein the upper loop and the lower loop are generally co-planar and are in immediate connection with one another, wherein the arm extends in a U-shape towards the second end where the loop connector and the hook connector releasably engage with one another to close the lower loop, wherein the upper loop is oval, and wherein the lower loop is rectangular when closed, and wherein the arm has a first bend, a second bend, and a third bend along its length, wherein each of the bends are angled at 90 degrees.

2. The garment strap clip of claim 1, wherein the upper loop and the lower loop are elongated and are fixedly connected along a common edge.

3. The garment strap clip of claim 1, wherein the lower loop is resilient.

4. The garment strap clip of claim 1, wherein the hook connector extends upwardly.

5. The garment strap clip of claim 4, wherein the loop connector is constructed of a pliable and resilient material, wherein the loop connector is stretched upward to engage with, or disengage from, the hook connector.

6. The garment strap clip of claim 1, wherein the lower loop is larger than the upper loop, wherein at least a height of the lower loop is greater than a corresponding height of the upper loop.

7. The garment strap clip of claim 6, wherein a width of the lower loop is greater than a corresponding width of the upper loop.

8. The garment strap clip of claim 1, wherein the first bend is located adjacent to the upper loop's first end and the third bend is located adjacent to a distal portion of the arm, inclusive of the loop connector, wherein the distal portion of the arm pivots at the third bend.

9. The garment strap clip of claim 1, wherein the upper loop, the arm, the loop connector, and the hook connector are constructed of a material having a circular cross-section and a uniform diameter.

* * * * *